US007581343B1

(12) United States Patent
Baxter

(10) Patent No.: US 7,581,343 B1
(45) Date of Patent: Sep. 1, 2009

(54) QUILT DISPLAY FRAME

(76) Inventor: Loren Baxter, 70 Vernal Ct., Alamo, CA (US) 94507

( * ) Notice: Subject to any disclaimer, the term of this patent is extended or adjusted under 35 U.S.C. 154(b) by 246 days.

(21) Appl. No.: 11/723,215

(22) Filed: Mar. 19, 2007

(51) Int. Cl.
*G09F 17/00* (2006.01)

(52) U.S. Cl. ..... 40/603; 40/604

(58) Field of Classification Search ..... 40/603, 40/604, 606.17, 610; 248/463, 465, 351; 160/337, 381, 371, 379; 403/119, 164
See application file for complete search history.

(56) References Cited

U.S. PATENT DOCUMENTS

| | | | |
|---|---|---|---|
| 875,261 | A | 12/1907 | Heam |
| 895,744 | A | 8/1908 | Goldberger |
| 940,070 | A | 11/1909 | Russell |
| 991,476 | A | 5/1911 | Brooks |
| 2,000,397 | A | 5/1935 | Knutson |
| 2,177,720 | A | 10/1939 | Janssen |
| 2,242,386 | A | 5/1941 | Block et al. |
| 2,318,877 | A | 5/1943 | Meyer et al. |
| 2,455,640 | A | 12/1948 | Ashbaugh |
| 4,658,521 | A | 4/1987 | Thorpe |
| 4,665,638 | A | 5/1987 | Morton |
| 4,736,535 | A | 4/1988 | Rucker |
| 5,711,098 | A | 1/1998 | Warne |
| 6,209,240 | B1 | 4/2001 | Engle |

*Primary Examiner*—Cassandra Davis
(74) *Attorney, Agent, or Firm*—Theodore J. Bielen, Jr.

(57) ABSTRACT

A quilt display frame utilizing a sheet of flexible material having a peripheral edge with a plurality of sleeves. Poles are placed within the sleeves and connected to one another to form a frame member. A connector is employed to this end which includes a pair of tubes that are connected to each other by a bridge a pair of legs are clipped on to the poles to support the frame on a surface in a upright position in order to allow a surface of the sheet to be used for holding patches for previewing a quilt design.

12 Claims, 3 Drawing Sheets

QUILT DISPLAY FRAME

BACKGROUND OF THE INVENTION

Present invention relates to a novel and useful design frame for previewing quilting work.

Quilting requires the assemblage of pieces or patches of material into a pattern or design which are connected by sewing the same together into a unit. Typically, quilting is performed as a group effort requiring the imagination and creativity of many persons.

In the past, quilt designs have been predetermined by the use of stretching and drawing. In addition, quilt patterns have been predetermined by placing pieces of the quilt together on a floor or table in order to visualize the eventual pattern of the quilt. The prior system of laying out the pattern of the quilt has proven to be inconvenient and inefficient, since a great deal of horizontal space in a facility is required to achieve this result.

Many structures has been proposed to support fabric sheets for the purposes of making tapestries and quilts. For example, the U.S. Pat. Nos. 875,261, 895,744, 2,242,386 describes stretcher for supporting sheets of material for the purposes of drying the same following washing or other treatments in which such sheets are contacted by water.

U.S. Pat. No. 4,736,535, describes a vertical embroidery frame utilizing retaining bars which maybe adjusted and which also includes casters for mobility along a surface.

U.S. Pat. Nos. 940,070, 2,000,397, 4,665,638 describes quilting frames which hold a backing material in a horizontal position in order to allow the sewing of a quilt thereupon. These devices also include means for stretching the backing material to present a smooth and uninterrupted surface.

U.S. Pat. Nos. 2,177,720, 2,318,877, 4,658,521, 6,209,240 show quilting frame stands which holds a quilt backing sheet which is provided with components that are disassembled and reassembled to allow portability and versatility.

U.S. Pat. Nos. 991,476, 5,711,098 show quilting frame structures that hold quilts in a horizontal position and that include legs that are collapsible and extendable.

A design frame for previewing a quilting work which is convenient and portable would be a novel and useful item in the field of arts and crafts.

BRIEF SUMMARY OF THE INVENTION

A design frame for previewing a quilting work which is novel and useful is hereinbelow described.

The design frame device of the present invention includes as one of its elements a sheet of flexible material which includes a peripheral edge. The sheet of flexible material may be formed of any cloth, polymeric material, elastomeric material, and the like. The peripheral edge of the flexible sheet of material maybe constructed with a plurality of sleeves leaving an inward portion of the flexible material as a flat surface, which is suitable for mounting, quilting patches.

At least a first and second, preferably third and fourth, frame poles are placed within the sleeves of the periphery of the flexible material to form a four-sided design frame. Of course, the design frame may take other shapes such as faceted polygons circular or curved outlines, and the like.

A novel connector is also shown in the present invention for connecting the corners of the design frame device of the present invention. For example, the connector may include a pair of tubes connecting the ends or the portions of the poles that extend outside the sleeves formed on the flexible sheet. A bridge or reinforcing member interconnects the first and second tubes and determines a particular angle necessary to create the shape of the overall design frame. The bridge may include reinforcing caps to add strength to the connector.

A link is also included which rotatably hooks onto a particular frame pole of the device of the present invention such link would normally connect to the pole adjacent a connector and includes a tube that mates with an outwardly extending leg which contacts the ground surface upon which the frame is supported. One or more of such links maybe employed with one or more ground contacting legs.

Elongated braces may also be used to support the flexible sheet such that the inner portion receiving the quilt patches generally lies in a plane. Each crossbrace may extend between opposite poles which are parallel to each other or ones that are separated in a non-parallel configuration. Also, it should be noted that the elements used as the frame poles, ground contacting legs, and the braces, may be in similar construction and interchangeable with one another.

It may be apparent that a novel and useful design frame device for previewing a quilting work has been hereinabove described.

It is therefore an object of the present invention to provide design frame device for previewing a quilting work which includes a flexible sheet that may be oriented in a upright configuration for easy viewing.

Another object of the present invention is to provide a design frame device for previewing quilting work which is easily assembled and disassembled for portability.

A further object of the present invention is to provide a design frame device for previewing quilting work which presents a large surface area and does not occupy a large horizontal space in a quilting facility.

A further object of the present invention is to provide a design frame device for previewing quilting work which utilizes novel connectors and links that permits such device to be erected and disassembled quickly and easily.

A further object of the present invention is to provide a design frame device for previewing quilting work which is easy to manufacture and maintain.

The invention possesses other objects and advantages especially as concerns particular characteristics and features thereof which will be come apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 7:
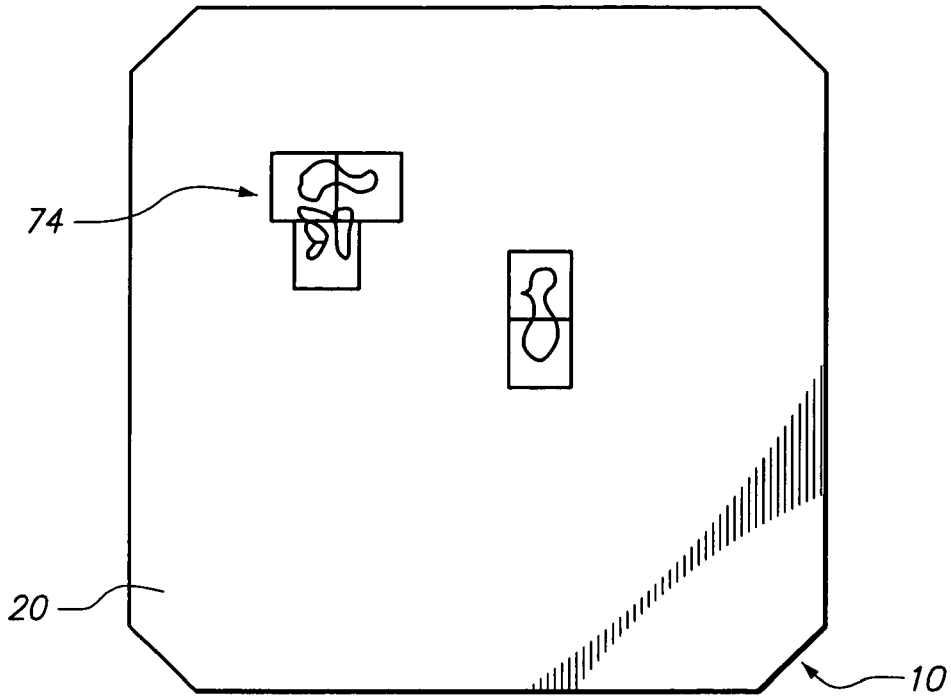
FIG. 7 is a front elevational view of the frame device of the present invention, shown schematically with typical quilt patches displayed therefore upon.

An embodiment of the invention as a whole shown in the drawings by reference character 10. Design frame device 10 includes as one of its elements a sheet of material 12 which is flexible. Sheet 12 may take the form of any cloth, polymeric material, and the like. For example, flannel would be an ideal material for use with the present invention. Sheet 12 includes a peripheral edge 14 and an inner portion 16. Side 18 of inner portion 16 is shown on FIG. 1, while display side 20 of inner portion 16 is depicted in FIG. 7. Sheet 12 includes sleeves 22,24,26,28 which form an outline of frame device 10 in the shape of a square. Of course, other shapes maybe formed by the structure of the present invention.

Frame poles 30, 32, 34, and 36 are also employed in the present invention. Frame poles 30, 32, 34, and 36 occupy sleeves 22, 24, 26, and 28, respectively. Frame poles 30, 32, 34, 36, maybe collapsible, such as poles employed with camping tents.

Figure 1:
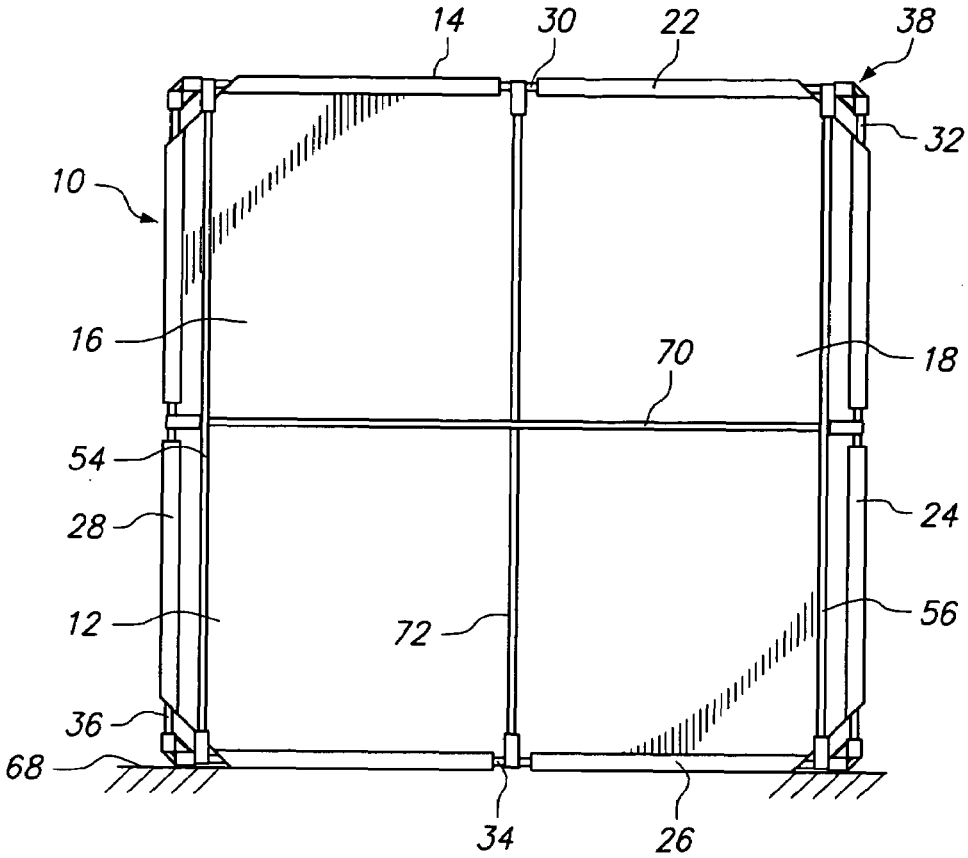
FIG. 1 is a rear elevational view of the device of the present invention in its erected configuration.
Figure 2:
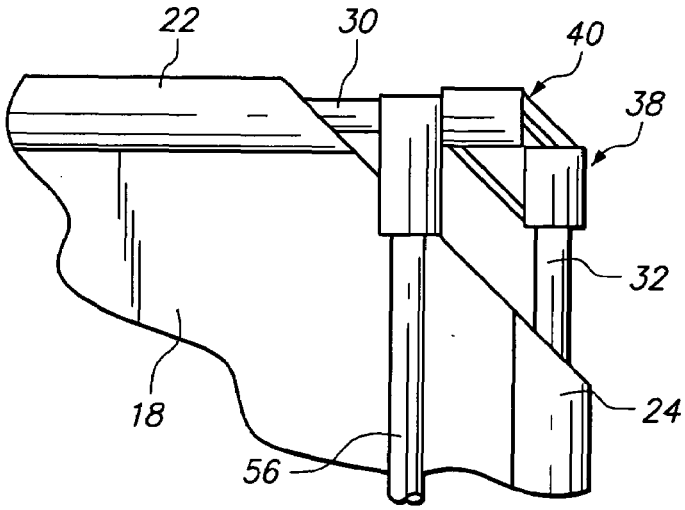
FIG. 2 is a front elevational view of a typical corner of the frame device shown in FIG. 1.

Referring now to FIG. 2, it may be observed that a typical corner portion 38 of device 10 is depicted. As may be observed, frame poles 30, and 32 each include a portion which lies within sleeves 22, and 24, respectfully, as well as a portion that lies outside of such sleeves. The same structure applies to the interconnection of the remainder of frame poles 34, and 36 as maybe seen in FIG. 1.

Figure 3:
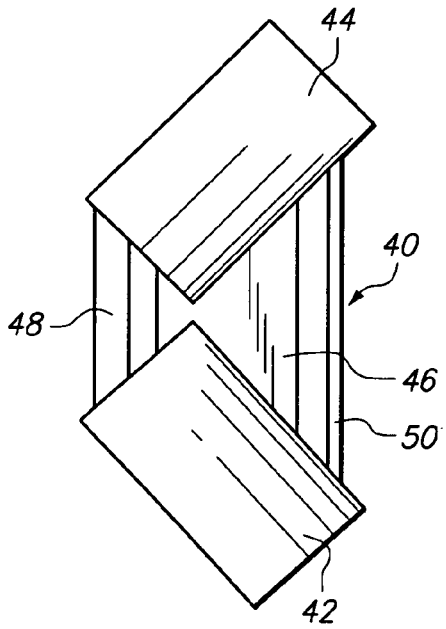
FIG. 3 is a top plan view of the connector used in the frame device in the present invention.
Figure 4:
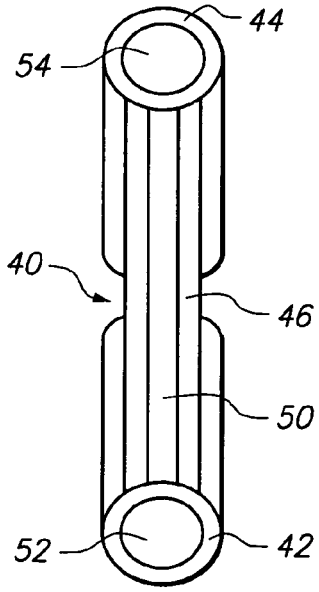
FIG. 4 is a bottom plan view of the connector depicted in FIG. 3.
Figure 6:
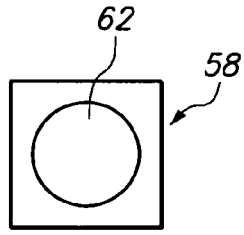
FIG. 6 is a bottom plan view of the link depicted in FIG. 5.

A connector 40 holds frame poles 30, and 32 in place at a right angle in the present embodiments of the invention. Referring to FIGS. 3 and 4, it may be apparent that connected 40 possesses with tubes 42, and 44 connector by a bridge member 46. Bridge member 46 includes strengthening end caps 48 and 50. That is to say, tubes 42, and 44 have apertures 52 and 54, respectfully, which accommodate frame poles 30 and 32 and are rounded in configuration. Connector 40 maybe formed of any rigid or semi-rigid material such as plastic, wood, metal, and the like.

Figure 5:
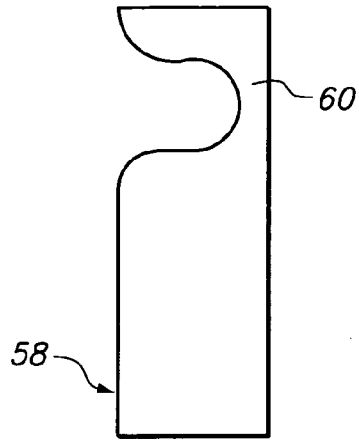
FIG. 5 is a side elevational view of the link used with the ground supporting poles of the device of the present invention.

With reference to FIG. 1, it maybe seen that ground contacting poles 54, and 56 are shown. Turning to FIG. 2, ground contacting pole 56 is held to frame pole 30 by a link 58 having a rotatable hook 60 which gently snaps onto frame pole 30, FIG. 5. Link 58 also includes an aperture 62 which accommodates ground contacting pole 56. It should also be noted that sleeve 26 would contact ground surface 68 to form a stable support for device 10. Although a pair of ground contacting poles 54, and 56 are depicted in the drawings, any number of ground contacting poles maybe employed in the present invention.

Braces 70, and 72 span or extend between frame poles 32, and 36, as well as frame poles 30, and 34, respectively. FIG. 1. Such braces may use link 58 in such connection for other means to achieve this result. Also, sleeves 22, 24, 26, and 28 may possess gaps or openings to allow the interconnections of braces 70, and 72 with the particular frame poles 30, 32, 34, and 36 as is shown in the drawings.

Figure 8:
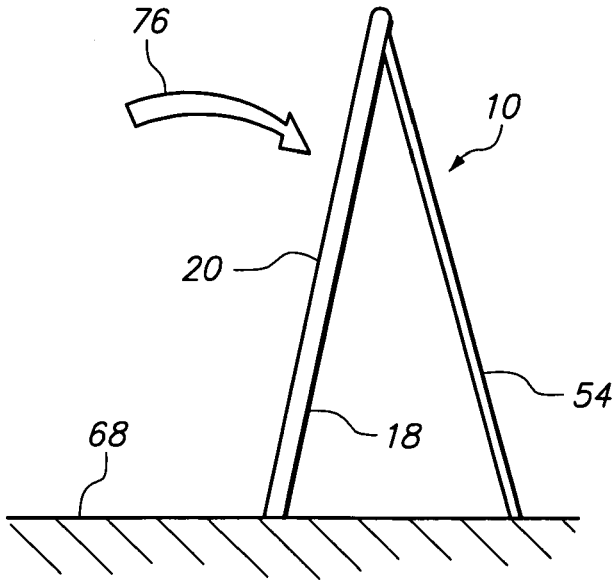
FIG. 8 is a side elevational view of the frame depicted in FIG. 7.

In operation, the user assembles frame device 10 by placing frame poles 30, 32, 34, and 36 within sleeves 22, 24, 26, and 28, respectively. Braces 70, and 72 span frame pole 30, and 34 as well as frame poles 32, and 36, respectively. Ground support legs 54, and 56 are then attached to device 10. It should be noted that connector 40 is employed to interconnect frame poles 30, 32, 34, and 36. Link 58 would be employed to interconnect ground port leg 54, and 56, while link 58 may also be used to hold braces 70, and 72 to device 10, as depicted. FIG. 7 illustrates the attachment of quilting patches 74 to display surface 20 to form a particular desired pattern. Quilting patches 74 maybe held by pins, an adhesive, static electricity, and the like. Directional arrows 76 indicates the placement of quilting patches 74 on display surface 20 of device 10, FIG. 8.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A design frame device for previewing quilting work, comprising:

a. a sheet of flexible material, said sheet including a peripheral edge and an inner portion apart from said peripheral edge, said sheet further comprising at a first sleeve and a spaced second sleeve at said peripheral edge;

b. a first frame pole having one portion lying inside said first sleeve with another portion of said first frame pole lying out side said first sleeve;

c. a second frame pole having one portion lying inside said second sleeve with another portion of said second frame pole lying outside said second sleeve;

d. a connector, said connector including a first tube for encompassing said another portion of said first frame pole, a second tube for encompassing said another portion of said second frame pole, and a bridge connecting said first and second tubes;

e. a first ground contacting leg having an outwardly extending end;

f. a second ground contacting leg having an outwardly extending end; and g. one link having a hook rotatably, attached to said another portion of said first pole and a tube connected to said outwardly extending end of said first ground contacting leg.

2. The device of claim 1 which additionally comprises a second link having a hook rotatably attached to said first frame pole and a tube connected to said second ground contacting leg.

3. The device of claim 1 which further comprises a third frame pole, said sheet of flexible material further comprises a third sleeve, said third frame pole having one portion lying inside said third sleeve and another portion of said third frame pole lying outside said third sleeve.

4. The device of claim 3 which further comprises one elongated brace extending between said second and third poles.

5. The device of claim 3 which further comprises one elongated brace extending between said second and third poles.

6. The device of claim 5 which further comprises a fourth frame pole said sheet of flexible material further comprising a fourth sleeve, said fourth frame member having one portion lying inside said fourth sleeve with another portion of said fourth frame pole lying outside said fourth sleeve.

7. The device of claim 5 which further comprises a fourth frame pole, said sheet of flexible material further comprising a fourth sleeve, said fourth frame member having one portion lying inside said fourth sleeve with another portion of said fourth frame pole lying outside said fourth sleeve.

8. The device of claim 7 which further comprises another elongated brace extending between said first and fourth frame poles.

9. The device of claim 7 which further comprises another elongated brace extending between said first and fourth frame poles.

10. The device of claim 1 in which said bridge connecting said first and second tubes of said connector further includes a reinforcing end cap.

11. The device of claim 1 which additionally comprises a second link having a hook rotatably attached to said first frame pole and a tube connected to said second ground contacting leg.

12. The device of claim 1 which further comprises a third frame pole, said sheet of flexible material further comprises a third sleeve, said third frame pole having one portion lying inside said third sleeve and another portion of said third frame pole lying outside said third sleeve.

* * * * *